US011111669B1

(12) United States Patent
Ballew

(10) Patent No.: US 11,111,669 B1
(45) Date of Patent: Sep. 7, 2021

(54) POSITIONING AND SUPPORT TOOL FOR STEEL STUD FRAMING

(71) Applicant: Tony J. Ballew, Livingston, MT (US)

(72) Inventor: Tony J. Ballew, Livingston, MT (US)

( * ) Notice: Subject to any disclaimer, the term of this patent is extended or adjusted under 35 U.S.C. 154(b) by 0 days.

(21) Appl. No.: 17/006,831

(22) Filed: Aug. 29, 2020

Related U.S. Application Data

(60) Provisional application No. 62/893,305, filed on Aug. 29, 2019.

(51) Int. Cl.
*E04B 2/74* (2006.01)

(52) U.S. Cl.
CPC ..... *E04B 2/7457* (2013.01); *E04B 2/7409* (2013.01); *E04B 2002/7468* (2013.01)

(58) Field of Classification Search
CPC ..... E04B 2/7457; E04B 2002/7468; E04B 2/7409
USPC ..... 52/749.1–749.15, DIG. 4
See application file for complete search history.

(56) References Cited

U.S. PATENT DOCUMENTS 3,807,888 A * 4/1974 Bowman ..... B28B 11/08 404/93
3,837,132 A * 9/1974 Weller ..... E04B 2/74 52/479
3,852,935 A * 12/1974 Jones ..... E04B 2/78 52/481.1
3,982,370 A * 9/1976 Buffington ..... E04B 2/7457 52/481.2
4,654,978 A * 4/1987 Wolford, Jr. ..... B25H 7/00 33/403
4,773,163 A * 9/1988 Wolford, Jr. ..... B25H 7/00 33/474
4,835,923 A * 6/1989 Ybarra ..... E04B 2/7409 52/238.1
4,934,119 A * 6/1990 Ybarra ..... E04B 2/7409 52/238.1
5,615,122 A * 3/1997 Lacrosse ..... B23P 15/12 227/100
5,863,169 A * 1/1999 Inkeroinen ..... E04G 21/167 414/11
8,366,065 B2 * 2/2013 Kane, Jr. ..... G01C 15/004 248/200
9,534,412 B2 * 1/2017 DeRita ..... E04G 23/02
2016/0047117 A1 * 2/2016 DeRita ..... E04G 23/0296 52/483.1
2021/0010512 A1 * 1/2021 Safar ..... F16B 35/04

FOREIGN PATENT DOCUMENTS

EP 3556956 A1 * 10/2019 ..... E04B 2/7411
WO WO-9702390 A1 * 1/1997 ..... E04B 2/7457

* cited by examiner

*Primary Examiner* — Rodney Mintz

(57) ABSTRACT

A positioning and support tool for steel stud top track installations with which to temporarily support the top track in reasonable proximity to its final, installed position so that the track may be quickly and safely installed by one person. The tool uses magnets applied directly to the underside of corrugated steel sheeting or other overhead structural members. A hanger member is attached to the magnets and is capable of being placed beneath the top track to support the track at, or in close proximity to, its final, installed orientation. The tool is configured so that it remains fully effective and equally secure on irregular planes of corrugated steel sheeting while offering an uncompromised and quantifiable weight rating.

11 Claims, 5 Drawing Sheets

POSITIONING AND SUPPORT TOOL FOR STEEL STUD FRAMING

CROSS-REFERENCE TO RELATED APPLICATIONS

This application claims the benefit of provisional patent application Ser. No. 62,893,305 filed Aug. 29, 2019

FEDERALLY SPONSORED RESEARCH

Not Applicable

SEQUENCE LISTING OR PROGRAM

Not Applicable

BACKGROUND OF THE INVENTION—FIELD OF INVENTION

This invention relates to fabrication and assembly tools, specifically to those used in steel stud framing.

BACKGROUND OF THE INVENTION—PRIOR ART

Figure 1:
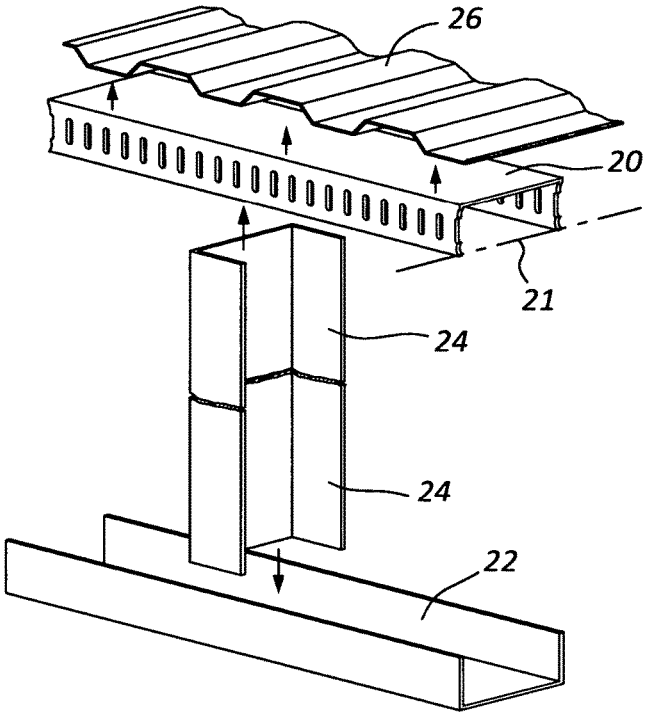

In the field of steel stud framing, multiple structural components are used. FIG. 1 shows framing components comprising bottom track 22 fastened to floor surfaces (not shown), top track 20 fastened to overhead ceiling surfaces, and steel studs 24 mounted vertically between bottom and top track. In its final, installed orientation, the top track profile comprises a horizontal web of predetermined width between two longitudinal edges, and two parallel, vertical legs of a predetermined height for receiving studs 24, configured as shown.

To delineate the location of walls and other features to be framed, location lines are typically applied, or "snapped" via chalkline to floor surfaces. Using lasers or plumblines, the location lines are then extended to the ceiling surfaces in order to correctly position and secure the top track to those surfaces. In commercial or industrial applications, the ceiling surfaces often comprise corrugated "ferrous," or steel sheets 26. The steel sheets are usually supported by a steel framework comprising steel trusses or I-beams 30, as in FIG. 4, and square tube columns.

The standard, full length of top track is ten feet and its width varies. With the location of the top track established as described, two-person teams often install the top track. One team member is usually on the ground positioning the laser, cutting track to specific lengths where needed, and helping support one end of the track with a stud of adequate length while the second team member, from an elevated work platform, aligns the track into final position and fastens it to sheets 26. This support scenario regularly proves to be awkward, inefficient, and even an unsafe procedure. In cases of extremely high ceilings requiring both team members to work from an aerial lift, many valuable man-hours are expended in up and down travel for laser repositioning and materials acquisition. In such a scenario, an additional team member may be called upon to assist with the process, but at the expense of increased installation costs.

Figure 2:
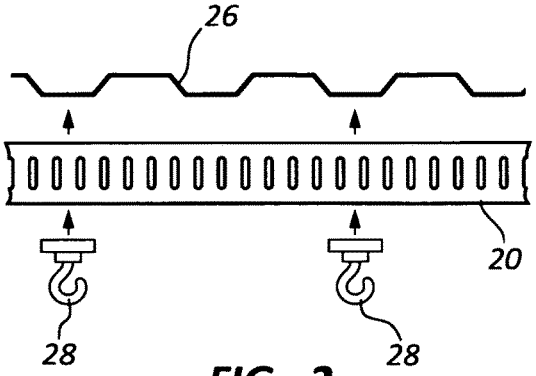
FIG. 2 (Prior Art)
Figure 3:
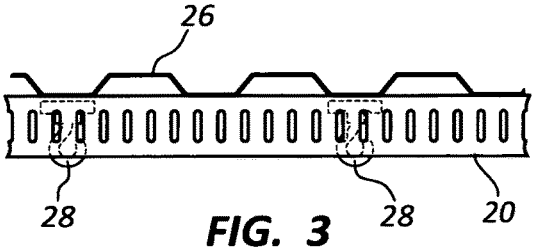
FIG. 3 (Prior Art)

One recent improvement of my own is shown in FIGS. 2-3 and uses powerful rare earth magnet assemblies 28. Placed into the top track at various locations where the track intersects with the steel sheets' corrugations, this procedure has shown promise by securing the track into final location, freeing ground personnel to perform other immediate duties and thus gaining valuable man-hours per shift. In an ideal situation, the magnets create a strong bond between the track and the sheeting as in FIG. 3.

The value of using magnets in this fashion relies entirely upon their ability to create an effective bond. One of the detriments to this method is that not all of the sheet corrugations are always exactly in the same plane, such as in locations where the sheets are supported by varying planes of the steel structural components described earlier and shown in FIG. 4, or simply where the sheets sag from the weight of concrete overhead. When fastened to such uneven surfaces, the top track flexes slightly across its web to match those surfaces. However, prior to fastening, such scenarios prevent the top track from contacting various corrugations per section of track, as at 34 in FIG. 4. When a magnet 28 is inadvertently applied to the top track in the location of such a corrugation, even if the gap is unnoticeable or only slight, it renders the magnet of little to no use. As such, extreme care must be taken to place the magnets at the points of contact between top track and corrugation, as at 32, FIG. 4. If not, a false sense of security is generated, thus creating a dangerous scenario in which even a slight disturbance of the track during the positioning or fastening procedure causes the track to separate from the steel sheeting and fall away.

Another detriment to the use of magnets in this way is that the strength of the magnet is compromised. Because the top track is steel, a portion of the force from the magnet's magnetic field is expended on the top track itself. This reduces the amount of force between the track and the steel sheeting to which the track is applied. Not only is the magnet less efficient, but the magnet's specified pull or weight rating is invalid and not applicable between the top track and steel surfaces to which it contacts.

To help overcome the above-noted shortcomings of using magnets in this fashion, some personnel have suggested increasing the number of magnets, using more powerful magnets, or doing both. Doing any of these, however, fails to definitively address the underlying problem. It also makes magnet removal more difficult and fails to rise to the level of safety and security required.

Until now, there have been no known tools offered which use magnetic force applied directly to overhead steel sheeting by which to temporarily and securely support the top track in reasonable proximity to its final position so that the track may be quickly and securely fastened by one person.

BACKGROUND OF INVENTION—OBJECTS AND ADVANTAGES

Accordingly, several objects and advantages of the present invention are to provide a steel stud framing positioning and support tool for installation of top track on corrugated steel sheeting or steel structural members (a) which reduces the number of workers required for top track installation;
(b) which is deployed and removed without the use of tools;
(c) which provides a higher degree of safety by remaining fully effective and equally secure on irregular planes of corrugated steel sheeting;
(d) which supports the top track within reasonable proximity to the steel sheeting and to its final, installed lateral and longitudinal position; and (e) which provides a higher degree of safety by offering an uncompromised, quantifiable weight rating.

SUMMARY

In accordance with the present invention, a positioning and support tool for steel stud top track installations in which top track is to be fastened to the underside of corrugated steel sheeting or other steel components. The tool uses a pair of magnets which connect directly to steel sheeting or other structural components. A track hanger is fastened to the magnets in such a way that the top track rests on the track hanger and is safely held captive by the tool.

DRAWINGS—Figures

FIG. 1—Framing component orientations

Figure 4:
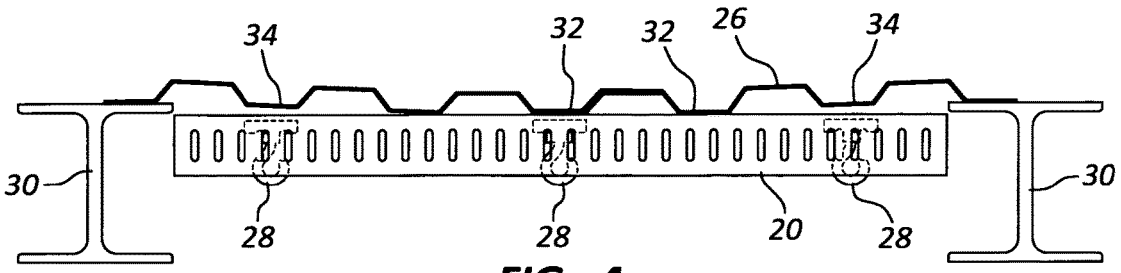
FIG. 4 (Prior Art)
Figure 5:
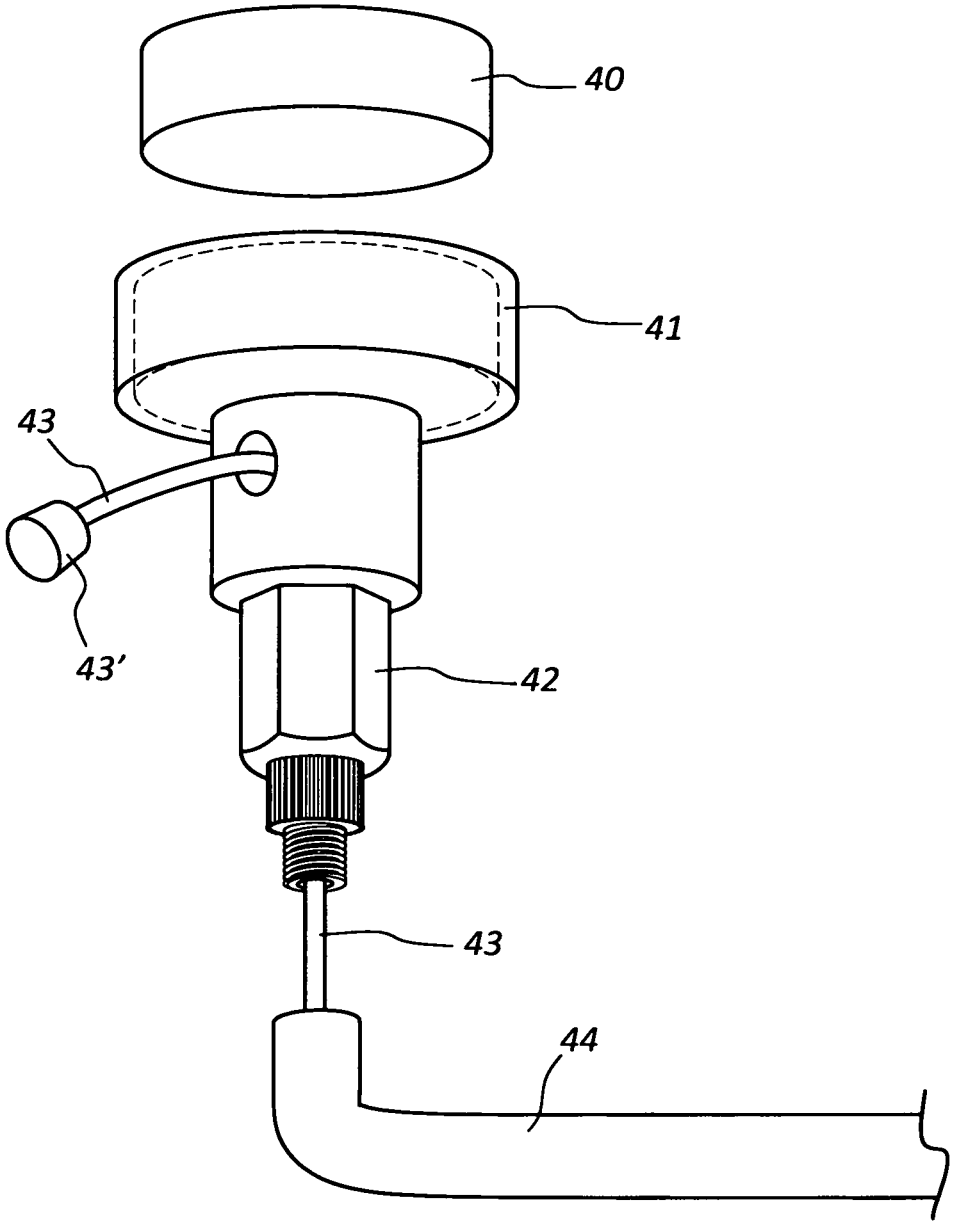
Figure 6:
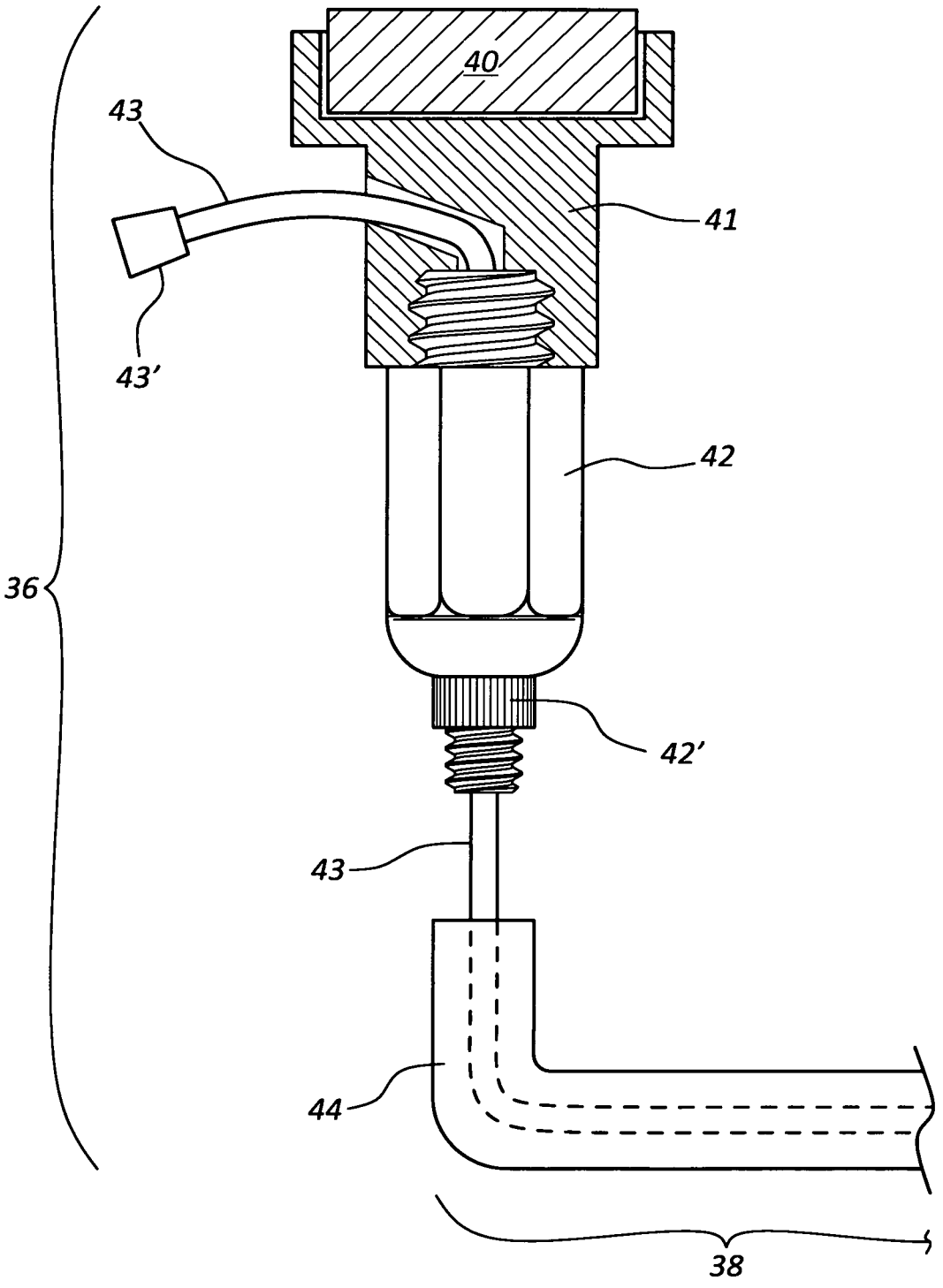
Figure 7:
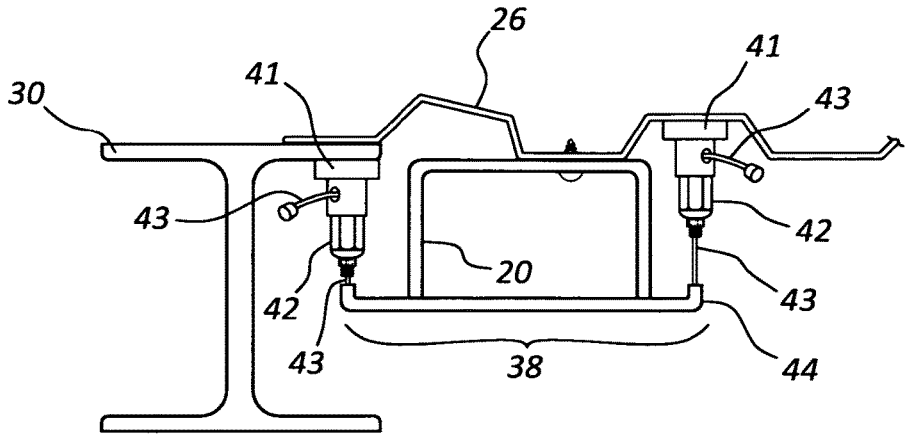
Figure 8:
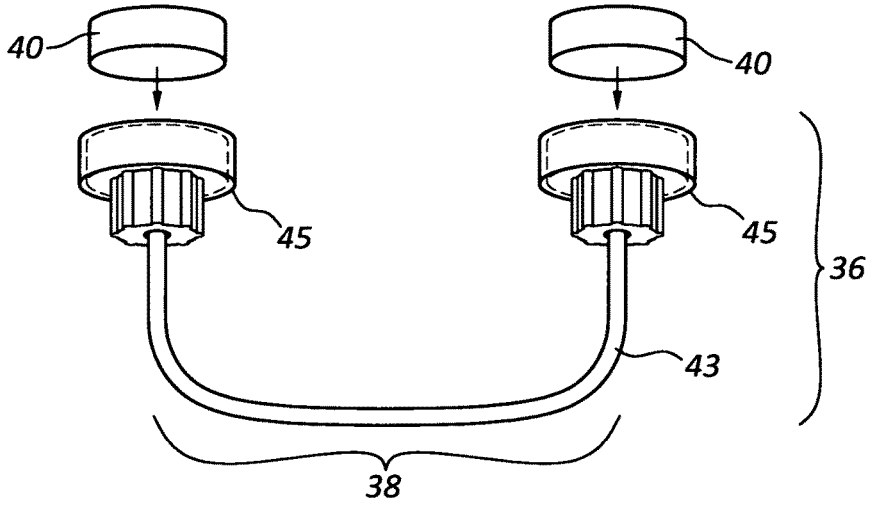
Figure 9:
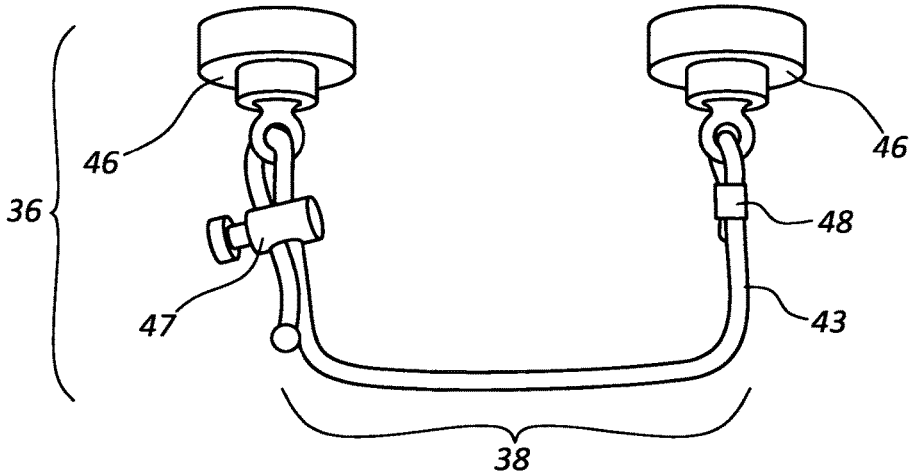
Figure 10:
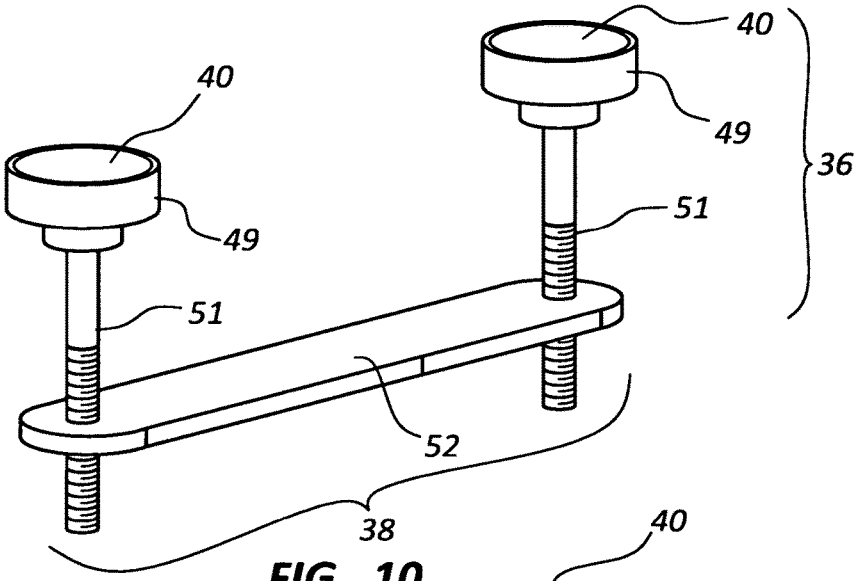
Figure 11:
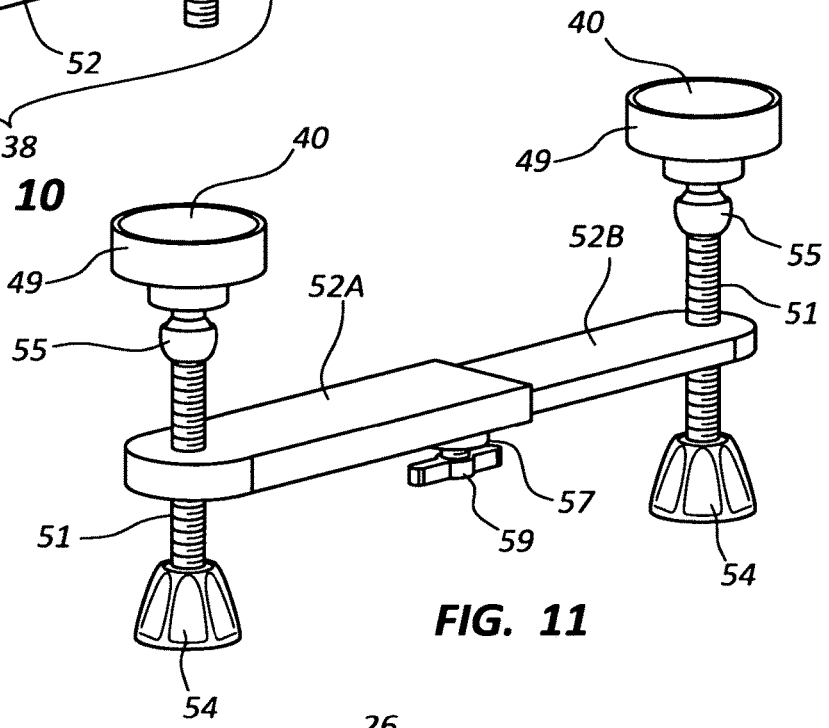
Figure 12:
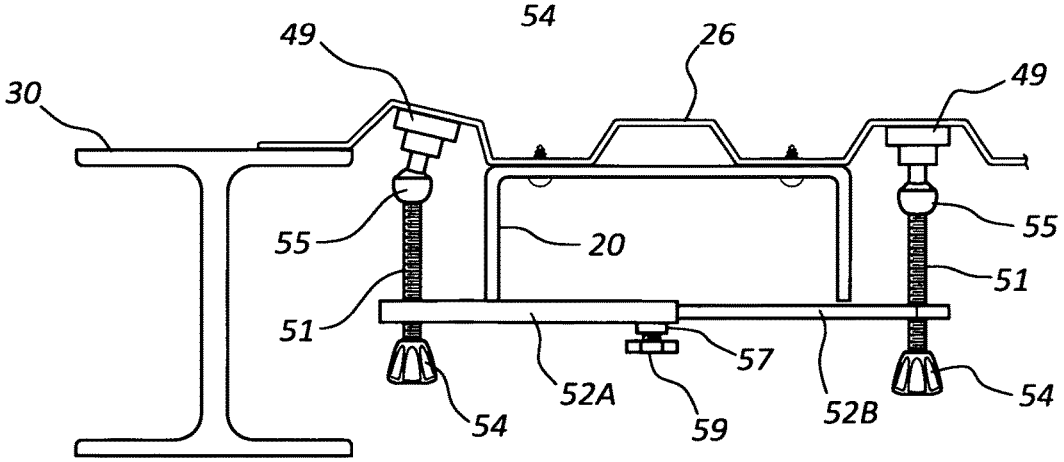

FIG. 2—Prior art, shows positioning of magnets for securing top track, side view FIG. 3—Prior art, magnets in position; holding track to sheeting FIG. 4—Prior art, side view showing irregular plane of sheeting and ineffective magnet placement FIG. 5—Preferred embodiment of the present invention FIG. 6—Detail of the preferred embodiment with cross-section of magnet pot FIG. 7—End view of top track supported by the preferred embodiment FIG. 8—Alternative embodiment with swaged pot FIG. 9—Alternative embodiment with formed magnet and alternative cable adjuster FIG. 10—Alternative rigid embodiment FIG. 11—Alternative, two-piece horizontal support section with added swivel fittings FIG. 12—End view of an alternative, horizontal support section supporting a top track

DRAWINGS—REFERENCE NUMERALS

20—top track
21—horizontal plane across distal ends of vertical top track legs
22—bottom track
24—stud
26—corrugated sheeting
28—prior art magnet assembly
30—I-Beam
32—contact areas between top track and corrugations
34—non-contact areas between top track and corrugations
36—vertical support section
38—horizontal support section
40—magnet with magnetic upper bonding surface
41—preferred embodiment magnet pot with internal threads
42—cable length adjuster; Strut Lock® style
42'—Strut Lock™ cable lock nut
43—cable
43'—cable stops
44—cable protector sleeve
45—alternative pot, swaged style
46—alternative magnet with formed eyelet
47—alternative cable length adjuster, barrel connector style
48—swaged cable connector
49—alternative pot with internal threads
51—alternative track hanger, threaded rod vertical support section
52—alternative track hanger, rigid horizontal support section
52A—alternative two-piece horizontal support section, female portion
52B—alternative two-piece horizontal support section, male portion
54—knob
55—swivel fitting
57—set screw nut
59—set screw with knob

DETAILED DESCRIPTION—PREFFERED EMBODIMENT—FIGS. 5, 6, 7

FIGS. 5 and 7 show the preferred embodiment in a deployed orientation comprising a pair of disc-shaped magnets 40 having magnetic upper bonding surfaces at their uppermost planes. Magnets 40 are mounted in pots 41.

In FIG. 6, pot 41 is bored vertically and tapped to accommodate a RIZE, LLC brand Strut Lock™ cable length adjuster assembly 42, which is threadedly mated into the tapped bore. The StrutLock™ adjuster is a tensioned ball-bearing style assembly that houses internal ball bearings tensioned against a cable by way of a locknut 42' to secure the cable against unwanted movement. The vertical bore extends upward into pot 41 beyond what is necessary for tapping the threads so that a diagonal bore through the side of pot 41 intersects with the vertical bore. A cable 43 is inserted into the diagonal bore and routed downward into the vertical bore. Cable 43 then passes through adjuster assembly 42 and emerges vertically below the assembly. The adjuster 42 and vertical section of cable 43 comprise a vertical support section 36. An axis through the upper and lower ends of the vertical section of cable 43 define a longitudinal axis (not indicated) that is substantially at a right angle, or perpendicular to magnetic upper bonding surface of magnet 40, as shown.

Cable 43 is then routed into a horizontal cable protector sleeve 44. The uppermost horizontal surface of sleeve 44 provides an upper support surface on which a top track rests. Sleeve 44 and the horizontal portion of cable 43 comprise a horizontal support section 38. The horizontal support section 38 and the vertical support sections 36 together comprise a track hanger.

Cable 43 (FIG. 7) exits upward vertically from sleeve 44, passes through a second adjuster 42, and exits to the outside of pot 41. Cable stops 43' are fastened onto each end of cable 43.

Operation—Preferred Embodiment—FIGS. 6, 7

To deploy the tool, the cable length is first adjusted by loosening the cable lock nuts 42' and moving the upper vertical sections of cable further into or out of adjusters 42 until the upper support surface is located at an adequate distance from magnetic upper bonding surfaces of magnets 40. An adequate distance is attained when the horizontal support section 38 is capable of being positioned beneath the top track's vertical legs during magnetic bonding of magnets to a specific overhead structure. When desired cable length is attained, the cable lock nuts 42' are tightened. A first magnet 40 is then placed into contact with, or adjacent to corrugated steel sheeting 26 or other structural steel component in the desired location. Top track 20 is then placed into position against sheeting 26 in close proximity to its intended, or installed lateral and longitudinal position. A first vertical support section 36 thus hangs in a downward direction alongside a first vertical leg of top track 20. The horizontal support section 38 is then passed horizontally beneath the vertical legs of top track 20. The remaining, or second vertical support section 36 is then extended upwards alongside the opposite, or second vertical leg of top track 20, and a second magnet 40 is then placed into contact with the underside of corrugated sheeting 26. The top track is thus supported, and the process is repeated until the desired number of tools are in position. Top track 20 may then be fastened to sheeting 26.

Alternative Swage-Style Embodiment; Detailed Description—FIG. 8

Magnets 40 are secured by appropriate means into pots 45. Pot 45 comprises a material that may be swaged. Each upper end of a predetermined length of cable 43 is inserted into a vertical bore of sufficient size located in the underside of each pot. Pots 45 are then swaged onto the cable ends by appropriate means.

Operation; Swage-Style Embodiment—FIG. 7

A first magnet 40 is placed into contact with sheeting 26 or other structural steel component in the desired location. Top track 20 is then placed into position against sheeting 26. A first vertical support section of cable 43 thus hangs in a downward direction alongside a first vertical leg of top track 20. A horizontal support section of cable 43 is then passed horizontally beneath the vertical legs of top track 20. The remaining, or second vertical support section of cable 43 is then extended upwards alongside the opposite, or second vertical leg of top track 20. The remaining, or second magnet 40 is then placed into contact with the underside of corrugated sheeting 26. The top track is thus supported at the desired location, and the process is repeated until the desired number of tools are in position.

Alternative Embodiment with Pre-Formed Magnets and Alternative Cable Length Adjustment Means—Background And Description—FIG. 9

In the preferred embodiment, magnets 40 are located within pots to facilitate the machining of threads for the Strut Lock™ assemblies. As an additional alternative, FIG. 9 eliminates the pots and instead employs specifically formed magnets 46 of a homogenous material such as that of a bonded magnet comprising a flat, magnetic upper bonding surface and an eyelet formed into the lower portion of the magnet, as shown. This embodiment further illustrates the use of a well-known type of barrel cable connector 47 as an alternative two-way cable length adjustment means. For this embodiment, one terminal or "dead" end of a cable 43 of predetermined length passes through a two-way barrel connector 47 in one direction and then loops through the eyelet of magnet 46, as shown, then passes back through connector 47 in the opposite direction to terminate adjacent to the weight-carrying, or "live" end of the cable. The other cable dead end loops through the eyelet of the opposing magnet and is swaged back onto the live end by swage cable connector 48. Swage connector 48 may be eliminated and replaced with a second two-way connector 47 if so desired.

Operation; Embodiment with Pre-Formed Magnets and Alternative Cable Adjustment Means—FIGS. 7, 9

Barrel connector 47 is released by squeezing the ends of the barrel toward its middle. Cable 43 is then adjusted to a desired length by extending or contracting the cables into or out of barrel 47. When desired length is obtained, barrel 47 is released. One of the magnets 46 is placed into contact with sheeting 26 in the desired location. Top track 20 is then placed into position against sheeting 26. A first vertical support section of cable 43 thus hangs downward from magnet 46 alongside one of the vertical legs of top track 20. A horizontal support section of cable 43 is then passed horizontally beneath the vertical legs of top track 20. The cable then passes upward, placing a second vertical support section alongside the remaining vertical leg. The final magnet 46 is placed into contact with the underside of sheeting 26 alongside top track 20 opposite the first magnet. The process is repeated until the desired number of tools are in position. When top track is fastened, tool is removed.

Alternative Rigid Embodiment; Detailed Description—FIG. 10

Magnets 40 (not shown) are secured into pots 49. Pots 49 are bored and tapped vertically in a fashion similar to the preferred embodiment. The upper ends of vertical support sections, comprising threaded rods 51, are threadedly mated with the tapped bores. A horizontal support section 52, comprising flat bar stock, is bored and tapped with bores being located at a predetermined distance from one another, as shown, to receive the lower ends of rods 51. The predetermined distance between the bores of the horizontal support section is equal to or greater than the predetermined width of the horizontal web of the top track.

Operation; Alternative Rigid Embodiment—FIG. 12

To adjust the vertical elevation of the horizontal support section 52, rods 51 are threaded into or out of section 52 until the desired distance between said magnetic upper surface and said upper support surface-is achieved. Top track 20 is then placed into contact with the underside of sheeting 26. Magnets 40 are placed into contact with sheeting 26 or other structural member at each side of track 20 to thus support top track 20. The process is repeated until the desired number of tools are in position.

Alternative Rigid Embodiment with Two-Piece Horizontal Support Section; Detailed Description—FIG. 11

FIG. 11 shows an alternative horizontal support section, and further includes additional swivel fittings. Pots 49 are vertically bored and tapped in fashion similar to the preferred embodiment. Swivel fittings 55 comprising an external upper thread (not shown) are threadedly mated with the internally tapped bores of pots 49. Swivel fittings 55 also comprise internal lower threads (not shown). The upper ends of vertical support sections 51, comprising externally threaded rods, are threadedly mated into the lower internal threaded bores of swivels 55. A horizontal support section, constructed of square or rectangular tube, comprises a male portion 52B, which is sized to slidably fit into a female portion 52A. A set screw nut 57 is fastened over a set screw bore (not shown) which passes through female portion 52A. A set screw 59 with set screw knob is threaded into nut 57. The orientation of the set screw and set screw nut thus provides a means for applying tension against the male portion 52B of the horizontal support section. The male and female portions each comprise a bore at a predetermined location near their outer ends which is tapped to receive the threaded rods 51, as shown. Knobs 54 are then secured to threaded rods 51 at the lower ends and provide a means of adjusting the length of rods 51.

Operation; Rigid Embodiment with Two-Piece Horizontal Support Section—FIG. 12

Set screw 59 is loosened slightly so that the male portion 52B of the horizontal support section may be slid further into or slid further out of the female portion of the horizontal support section 52A. When vertical support sections are separated to the desired width, set screw 59 is tightened. The threaded rods 51 are then threaded up or down to establish the correct vertical elevation by adjusting the distance from the upper support surface of the horizontal support section to the magnetic upper bonding surface of magnets 40. The vertical adjustment of rods 51 allows compensation for thicknesses of adjacent structural components, compensation for irregularities in the plane of the corrugated sheeting, or for optimum positioning of magnets. With preliminary adjustments complete, the track 20 is then placed into the desired location. The support is then positioned under the track, with magnets 40 placed against the steel sheeting 26 or other steel components. Additional positioning and support tools may be added as desired. When top track is in final position, it is fastened in prescribed fashion, and the tool is removed so that subsequent framing operations may proceed.

CONCLUSION, RAMIFICATIONS, AND SCOPE OF INVENTION

Thus the reader will see that the tool of the present invention provides a compact device that is specifically designed for safely supporting steel stud framing top track when fastening the track to steel surfaces and structures, that its use reduces installation time, offers a quantifiable weight rating, and reduces the number of personnel required for installation.

While my above description contains many specificities, these should not be construed as limitations on the scope of the invention, but rather as an exemplification of one preferred embodiment thereof. Many other variations are possible. For example, other types of cable length adjustment means may be used, such as the Kwik Loc™ two-way style cable connector manufactured by RIZE Enterprises®.

Also regarding the cable length adjusters, the drawing figures show two of these embodiments as positioned in the area of the vertical support section. Some types of adjusters may also be effectively positioned in the horizontal support section.

Another possible variation to the embodiments presented is that the adjustment to the vertical elevation provided by the threaded rods of the rigid versions may also be accomplished by other means, such as a tooth and pawl system similar to that used in cable ties. This could be accomplished by replacing the threaded rod with vertical members into which teeth are machined. These vertical members would be mated to releasable pawls fitted into the horizontal support sections so that each pawl engages the teeth of a vertical member as they pass through the horizontal support sections.

Accordingly, the scope of the invention should be determined not by the embodiments illustrated, but by the appended claims and their legal equivalents.

I claim:

1. A system for temporarily supporting a top track during a steel stud framing operation comprising:

(i) said top track configured to be attached to an overhead structure, said top track comprising an elongate section composed of a rigid material formed into a profile including a horizontally-oriented web of a predetermined width located between two longitudinal edges, and two substantially parallel, vertically-oriented legs of predetermined height; said vertically-oriented legs being joined to said web along said longitudinal edges so that each respective leg of said vertically-oriented legs extends in a downward direction from each respective edge of said longitudinal edges of said web; and (ii) a removable positioning and support tool comprising:

(1) a plurality of magnets, each of said magnets comprising a magnetic upper bonding surface configured to magnetically bond to said overhead structure, and (2) a track hanger suspended from said overhead structure via said magnets, said track hanger comprising:

(a) a plurality of vertical support sections, said vertical support sections having a minimum length equal to or greater than said predetermined height of said vertically-oriented legs of said top track, each of said vertical support sections comprising an upper end, and a lower end, and a longitudinal axis located between said upper end and said lower end; said upper end of a respective said vertical support section being joined to one of said magnets so that said longitudinal axis is oriented substantially perpendicular to said magnetic upper bonding surface; and (b) a horizontal support section joined to said lower end of each of said vertical support sections, said horizontal support section being of a predetermined width, and being joined to said vertical support sections so that a distance between at least two of said vertical support sections is equal to or greater than said predetermined width of said horizontally-oriented web of said top track, said horizontal support section comprising an upper support surface, said horizontal support section also being joined to said vertical support sections so that at least one of said vertically-oriented legs of said top track directly contacts and rests on said upper support surface;

wherein said positioning and support tool is configured to be removed from contact with said top track by a user's hand without any additional tools.

2. The system of claim 1 wherein each of said vertical support sections comprise a threaded rod and wherein said horizontal support section comprises a plurality of threaded bores therethrough; said threaded bores being of predetermined size so that said threaded rod is capable of being threadedly mated with said threaded bores so that said vertical support sections are capable of being threaded into and out of said bores of said horizontal support section so that a distance between said magnetic upper surface and said upper support surface is capable of being altered; said threaded bores being located in said horizontal support section so that a distance between at least two of said threaded bores is equal to or greater than said predetermined width of said horizontally-oriented web of said top track.

3. The system of claim 1 wherein each of said vertical support sections comprise a plurality of teeth, said teeth being of a predetermined shape capable of being engaged with a pawl; and wherein said horizontal support section comprises a plurality of voids therethrough, said voids being of predetermined size capable of allowing said vertical support sections to pass through said horizontal support section; said horizontal support section also comprising releasable pawls affixed to said horizontal support section, said pawls being affixed to said horizontal support section so that said pawls are capable of being releasably engaged with said teeth of said vertical support sections.

4. The system of claim 1 wherein each of said magnets further include an eyelet, said eyelet being of a predetermined dimension and predetermined location capable of receiving a dead end of a cable so that said dead end passes through said eyelet and then bends 180 degrees to a final position adjacent to a live end of said cable so that said dead end is capable of being fastened to said live end with a cable connector.

5. The system of claim 4 wherein said cable connector comprises a swaged sleeve.

6. The system of claim 4 wherein said cable connector comprises a two-way cable length adjuster.

7. The system of claim 1 wherein said vertical support sections and said horizontal support section together comprise a cable.

8. The system of claim 7 wherein said cable further includes a cable protector.

9. The system of claim 7 wherein said cable further includes a cable length adjuster, said cable length adjuster being in contact with said cable so that a length of said cable between said magnetic upper bonding surface and said upper support surface is capable of being adjusted.

10. The system of claim 9 wherein said cable length adjuster comprises at least one ball-bearing; said ball-bearing being releasably tensioned against a portion of said cable.

11. A method of using the system of claim 1 comprising:

(a) providing the overhead structure for supporting the top track and bonding to a respective said magnet;

(b) providing the top track for receiving subsequent framing components;

(c) positioning said top track into an orientation substantially near to an installed, lateral and longitudinal position;

(d) providing a first magnet of the plurality of magnets operatively joined to the upper end of a first vertical support section of the plurality of vertical support sections for magnetically bonding said first vertical support section to said overhead structure;

(e) positioning said first magnet into an orientation so that said first vertical support section is positioned adjacent to a first vertical leg of the two vertically-oriented legs of said top track;

(f) magnetically bonding said first magnet to said overhead structure;

(g) providing the horizontal support section operatively joined to the lower end of said first vertical support section for suspending a first end of said horizontal support section to said overhead structure;

(h) positioning said horizontal support section beneath said top track;

(i) providing a second vertical support section of the plurality of vertical support sections operatively joined between a second end of said horizontal support section and a second magnet of the plurality of magnets for magnetically bonding said second end of said horizontal support section to said overhead structure;

(j) positioning said second magnet into an orientation in which said second vertical support section is positioned adjacent to a second vertical leg of the two vertically-oriented legs of said top track;

(k) magnetically bonding said second magnet to said overhead structure; and (l) repeating the steps (a) through (k), if necessary, until a desired quantity of support is achieved.

* * * * *